US011241884B2

(12) United States Patent
Fukushima

(10) Patent No.: US 11,241,884 B2
(45) Date of Patent: Feb. 8, 2022

(54) WASTE LIQUID BOX MANAGEMENT METHOD, WASTE LIQUID BOX, PRINTER, AND WASTE LIQUID BOX MANAGEMENT SYSTEM

(71) Applicant: SEIKO EPSON CORPORATION, Tokyo (JP)

(72) Inventor: Shigeki Fukushima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/715,912

(22) Filed: Dec. 16, 2019

(65) Prior Publication Data

US 2020/0189285 A1 Jun. 18, 2020

(30) Foreign Application Priority Data

Dec. 17, 2018 (JP) ..... JP2018-235636

(51) Int. Cl.
*B41J 2/17* (2006.01)
*B41J 2/165* (2006.01)
*B41J 2/175* (2006.01)

(52) U.S. Cl.
CPC ..... *B41J 2/1721* (2013.01); *B41J 2/16523* (2013.01); *B41J 2/17566* (2013.01); *B41J 2002/16573* (2013.01); *B41J 2002/1735* (2013.01)

(58) Field of Classification Search
CPC .. B41J 2/1721; B41J 2/16523; B41J 2/17566; B41J 2002/16573
See application file for complete search history.

(56) References Cited

U.S. PATENT DOCUMENTS 4,965,596 A * 10/1990 Nagoshi ..... B41J 2/16523 347/36
8,727,492 B2 * 5/2014 Mihara ..... B41J 2/1721 347/36

FOREIGN PATENT DOCUMENTS

JP 2011-083896 4/2011

* cited by examiner

*Primary Examiner* — Thinh H Nguyen
(74) *Attorney, Agent, or Firm* — Workman Nydegger

(57) ABSTRACT

A waste liquid box management method sets a type of ink to be contained in a container, for a waste liquid box that includes a coupling portion coupled to a printer, the container containing ink discharged from the printer via the coupling portion, and a storage unit. The waste liquid box management method individually allocates different storage regions, in the storage unit, to a plurality of ink types, writes predetermined type specification data into a selected storage region, that is the storage region allocated to the ink type to be contained in the container, and inhibits writing to the storage region other than the selected storage region in a state in which data other than the type specification data is stored therein.

7 Claims, 4 Drawing Sheets

WASTE LIQUID BOX MANAGEMENT METHOD, WASTE LIQUID BOX, PRINTER, AND WASTE LIQUID BOX MANAGEMENT SYSTEM

The present application is based on, and claims priority from JP Application Serial Number 2018-235636, filed Dec. 17, 2018, the disclosure of which is hereby incorporated by reference herein in its entirety.

BACKGROUND

1. Technical Field

The present disclosure relates to a waste liquid box management method, a waste liquid box, a printer, and a waste liquid box management system.

2. Related Art

In related art, in inkjet printers, a waste liquid box is provided for collecting waste ink generated when cleaning nozzles of an ink head, as described in JP-A-2011-83896, for example. When inks of different types, such as a pigment type, a dye type, a UV ink type, and the like are mixed in the waste liquid box, it becomes difficult to recycle the inks, and solidification of the inks causes a failure and the like of the waste liquid box.

Therefore, in the related art, by providing a waste liquid box dedicated to each type of inkjet printer, it is possible to prevent the different types of ink from being mixed in together in the waste liquid box.

In order to prevent mixing of inks of different types, when a waste liquid box dedicated to each type of inkjet printer is provided, there is inconvenience due to an inventory management load being large, because inventory of a large number of waste liquid boxes having different specifications must be managed.

SUMMARY

A preferred aspect for solving the above-described problem is, for example, a waste liquid box management method for setting a type of ink to be contained in a container, for a waste liquid box including a coupling portion coupled to a printer, the container containing ink discharged from the printer via the coupling portion, and a storage unit. The waste liquid box management method individually allocates storage regions, in the storage unit, to a plurality of ink types, writes predetermined type specification data into a selected storage region, that is the storage region allocated to an ink type to be contained in the container, and inhibits writing to the storage region other than the selected storage region in a state in which data other than the type specification data is stored therein.

In the waste liquid box management method described above, when the type specification data is written into one of the storage regions, discharge to the container may be allowed for an ink type to which the storage region in which the type specification data is written is allocated, and the discharge to the container may be inhibited for an ink type to which the storage region in which the type specification data is not written is allocated.

Another preferable aspect for solving the above-described problem is, for example, a waste liquid box that includes a coupling portion coupled to a printer, a container containing ink discharged from the printer via the coupling portion, and a storage unit configured to store ink type identification data identifying one of a plurality of ink types.

In the waste liquid box described above, the storage unit may include storage regions individually allocated to the plurality of ink types, and the ink type identification data may include predetermined type specification data written into any one of the storage regions, and data, other than the type specification data, stored in a non-rewritable manner in the storage region other than the storage region into which the type specification data is written.

Another preferable aspect for solving the above-described problem is, for example, a printer using an ink of a predetermined ink type, the printer including a waste liquid box management unit. When the printer is coupled by a coupling portion to a waste liquid box, which includes the coupling portion coupled to the printer, a container containing ink discharged from the printer via the coupling portion, and a storage unit storing ink type identification data identifying one of a plurality of ink types, the waste liquid management unit determines whether the ink type identified by the ink type identification data stored in the storage unit is the predetermined ink type, and, when it is determined not to be the predetermined ink type, performs notification that the waste liquid box is not able to be used or processing of inhibiting discharge of ink of the predetermined ink type into the waste liquid box.

In the printer described above, the storage unit may include different storage regions individually allocated to a plurality of ink types, and the ink type identification data may include predetermined type specification data written into any one of the storage regions, and data, other than the type specification data, stored in a non-rewritable manner in the storage region other than the storage region into which the type specification data is written. When an ink type allocated with the storage region in which the type specification data is written is different from the predetermined ink type, the liquid box management unit determines that the ink type identified by the ink type identification data is not the predetermined ink type.

Another preferable aspect for solving the above-described problem is, for example, a waste liquid box management system that includes a first printer configured to use ink of a first ink type, a second printer configured to use ink of a second ink type different from the first ink type, a coupling portion configured to be couplable to one of the first printer and the second printer, and a waste liquid box including a container containing one of the ink of the first ink type discharged from the first printer and the ink of the second ink type discharged from the second printer, and a storage unit in which storage regions are individually allocated with respect to the first ink type and the second ink type. When the first printer is coupled to the waste liquid box via the coupling portion, the first printer writes, in the storage unit, predetermined type specification data into the storage region allocated to the first ink type, and inhibits writing to the storage region allocated to the second ink type in a state in which data other than the type specification data is stored therein.

In the above waste liquid box management system, when the first printer is coupled to the waste liquid box via the coupling portion, when the type specification data is not stored in the storage region allocated to the second ink type, the first printer may perform one of processing to issue notification that the waste liquid box is not able to be used and processing to inhibit discharge of the ink of the first ink type into the waste liquid box.

Each aspect for solving the above-described problem may be realized in various forms other than the above-described waste liquid box management method, waste liquid box, printer, and waste liquid box management system. For example, an aspect may be a program of a computer or a processor for realizing the above-described waste liquid box management method, printer, and waste liquid box management system. Further, an aspect may be a recording medium in which the above-described program is recorded, a server device for delivering the program, a transmission medium for transmitting the program, a data signal in which the above-described program is embodied in carrier waves, and the like.

DESCRIPTION OF EXEMPLARY EMBODIMENTS

1. Configuration of Printer and Waste Liquid Box

Figure 1:
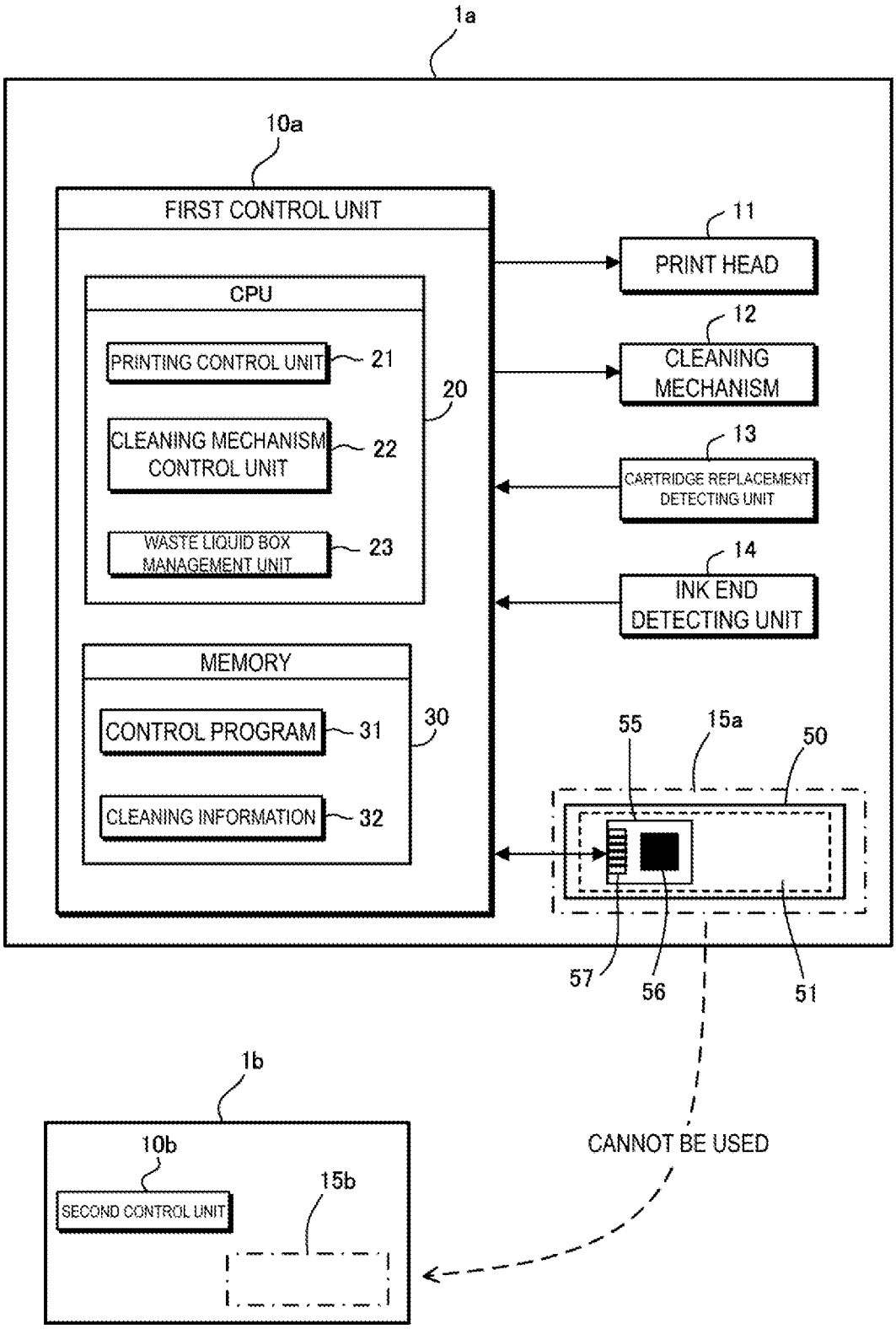
FIG. 1 is an explanatory diagram of main portions of a printer and a waste liquid box.
Figure 2:
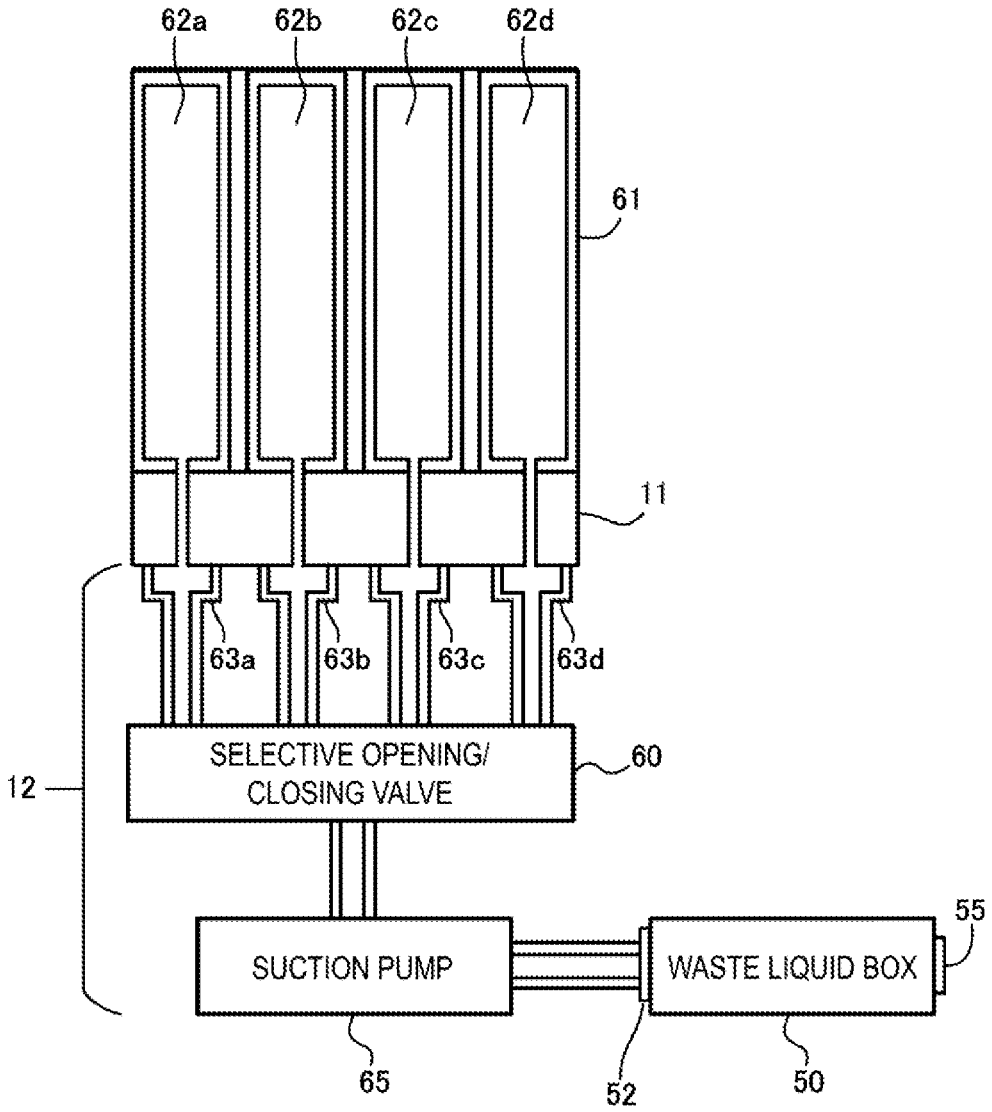
FIG. 2 is an explanatory diagram of a cleaning mechanism.

A configuration of a printer and a waste liquid box according to an embodiment to which the present disclosure is applied is described with reference to FIG. 1 to FIG. 2. FIG. 1 is an explanatory diagram of main portions of the printer and the waste liquid box. FIG. 2 is an explanatory diagram of a cleaning mechanism provided in the printer.

Referring to FIG. 1, a waste liquid box management system is configured by a first printer 1*a*, a second printer 1*b*, and a waste liquid box 50. The first printer 1*a* and the second printer 1*b* are inkjet printers, and the first printer 1*a* uses ink of a first ink type. Additionally, the second printer 1*b* uses ink of a second ink type different from the first ink type. Since the first printer 1*a* and the second printer 1*b* have the same configuration except for the different types of ink being used, the first printer 1*a* will be primarily described below.

Here, the difference between the ink types means that, when contained in the waste liquid box 50 in a mixed manner, trouble occurs due to sticking or the like as a result of the mixing, resulting in damage to the waste liquid box 50, leakage of waste liquid, a reduction in an absorption amount of a waste liquid absorbing agent housed within the waste liquid box 50, and the like. For example, when the first ink type is a pigment and the second ink type is a dye or UV ink, the first ink type and the second ink type are different ink types.

The waste liquid box 50 can be used for both the first printer 1*a* and the second printer 1*b*, but it is necessary to avoid mixing the ink of the first ink type used by the first printer 1*a* and the ink of the second ink type used by the second printer 1*b*. Here, as described below, the first printer 1*a* and the second printer 1*b* perform processing to prevent the ink of the first ink type and the ink of the second ink type from being discharged at the same time and mixed together in the waste liquid box 50.

The waste liquid box 50 is provided with a container 51 for containing waste liquid, and an IC chip 55. The IC chip 55 includes a storage unit 56 and a coupling terminal 57 that is coupled to a first control unit 10*a*, in order to write data into the storage unit 56 and read data stored in the storage unit 56. As described below, type specification data specifying the ink type for the waste liquid box 50 is written into the storage unit 56.

The first printer 1*a* includes the first control unit 10*a*, a print head 11, a cleaning mechanism 12, a cartridge replacement detecting unit 13, an ink end detecting unit 14, and the waste liquid box 50. The first control unit 10*a* is an electronic circuit unit configured by a Central Processing Unit (CPU) 20, a memory 30 and the like, and controls the overall operation of the printer 1*a*. The CPU 20 may be configured by one or more processors. A control program 31 of the first printer 1*a*, cleaning information 32, in which is recorded an implementation status of nozzle cleaning of the print head 11, and the like, are stored in the memory 30.

The CPU 20 functions as a printing control unit 21, a cleaning mechanism control unit 22, and a waste liquid box management unit 23, by reading and executing the control program 31 of the printer 1*a* stored in the memory 30. The waste liquid box management unit 23 executes a waste liquid box management method according to the present disclosure.

The printing control unit 21 controls the operation of the print head 11 to perform printing on paper (not illustrated). The cleaning mechanism control unit 22 controls the operation of the cleaning mechanism 12 to perform the nozzle cleaning of the print head 11. The ink discharged from the print head 11 as a result of performing the nozzle cleaning is contained in the waste liquid box 50.

The waste liquid box management unit 23 sets the new waste liquid box 50, which is mounted on a mounting portion 15*a*, to be used for the first ink type used by the first printer 1*a*. In addition, when the waste liquid box 50 mounted on the mounting portion 15*a* is already set for the second ink type, the waste liquid box management unit 23 inhibits the discharge of the ink of the first ink type into the waste liquid box 50.

Referring to FIG. 2, the print head 11 is fitted with an ink cartridge 61 having four ink containers 62*a*, 62*b*, 62*c*, and 62*d*. The cleaning mechanism 12 includes cap members 63*a*, 63*b*, 63*c*, and 63*d* provided so as to correspond to each of the ink containers 62*a*, 62*b*, 62*c*, and 62*d*. Furthermore, the cleaning mechanism 12 includes a selective opening/closing valve 60 coupled to each of the cap members 63*a*, 63*b*, 63*c*, and 63*d*, and a suction pump 65 coupled between the selective opening/closing valve 60 and the waste liquid box 50. The waste liquid box 50 is coupled to the suction pump 65 via a coupling portion 52.

When the nozzle cleaning of the print head 11 is performed, the cleaning mechanism control unit 22 selects the target ink container using the selective opening/closing valve 60, and causes the nozzle and the suction pump 65 to be communicated via the selective opening/closing valve 60. Then, by activating the suction pump 65, the cleaning mechanism control unit 22 sucks ink from the selected ink container and discharges it to the waste liquid box 50.

The cartridge replacement detecting unit 13 detects whether the ink cartridge 61 is mounted or removed, using a detection signal from a switch (not illustrated) that is pressed by the ink cartridge 61 when the ink cartridge 61 is mounted. The ink end detecting unit 14 calculates the amount of ink remaining for each of the ink containers 62*a*, 62*b*, 62*c*, and 62*d*, by integrating a number of dots formed by printing, the amount of ink consumed by the nozzle cleaning, and the like. Then, the ink end detecting unit 14 detects the end of the ink by determining whether a remaining amount of the ink has reached a predetermined ink end value.

The cleaning mechanism control unit 22 performs the nozzle cleaning of the ink head 11 when the replacement of the ink cartridge 61 is recognized on the basis of a detection result of the cartridge replacement detecting unit 13, and when the end of the ink is detected by the ink end detecting unit 14. Furthermore, the cleaning mechanism control unit 22 performs the nozzle cleaning of the print head 11 when a user performs an operation instructing the implementation of the nozzle cleaning.

2. Management of Waste Liquid Box

Figure 3:
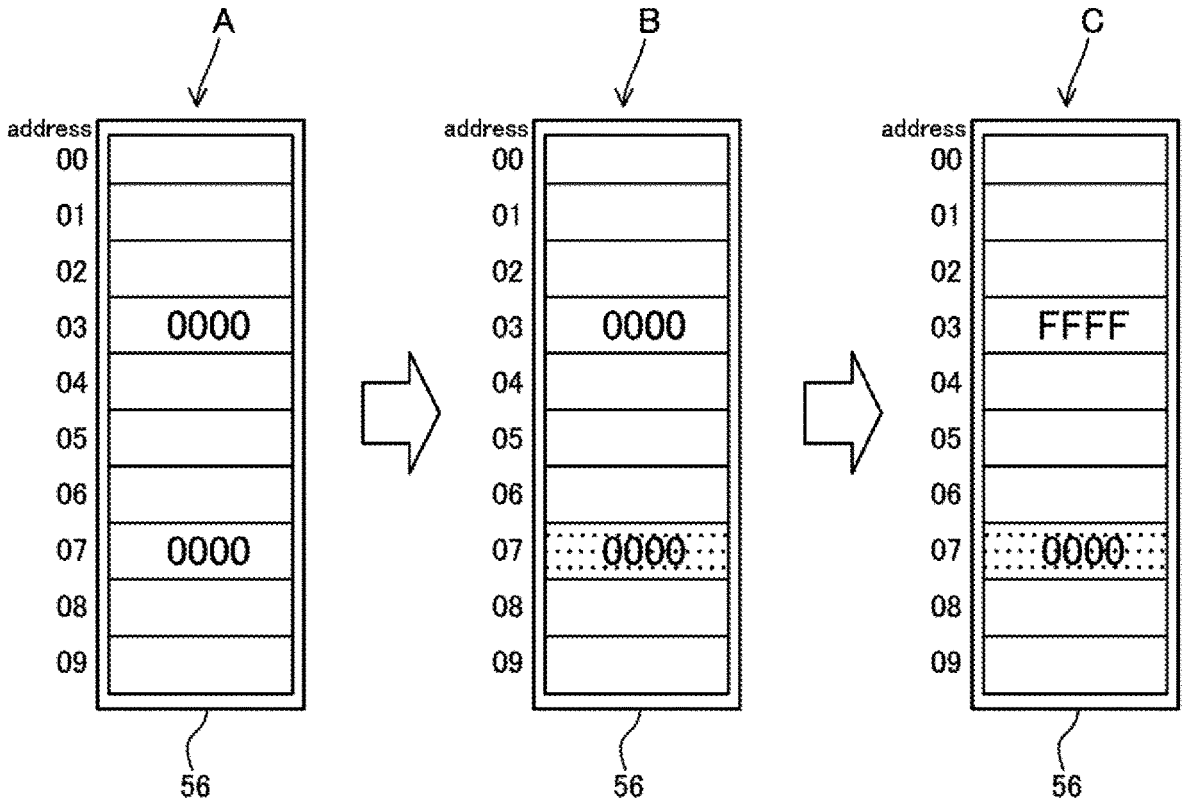
FIG. 3 is an explanatory diagram of processing to write data into a storage unit provided in the waste liquid box, for setting an ink type to be contained.
Figure 4:
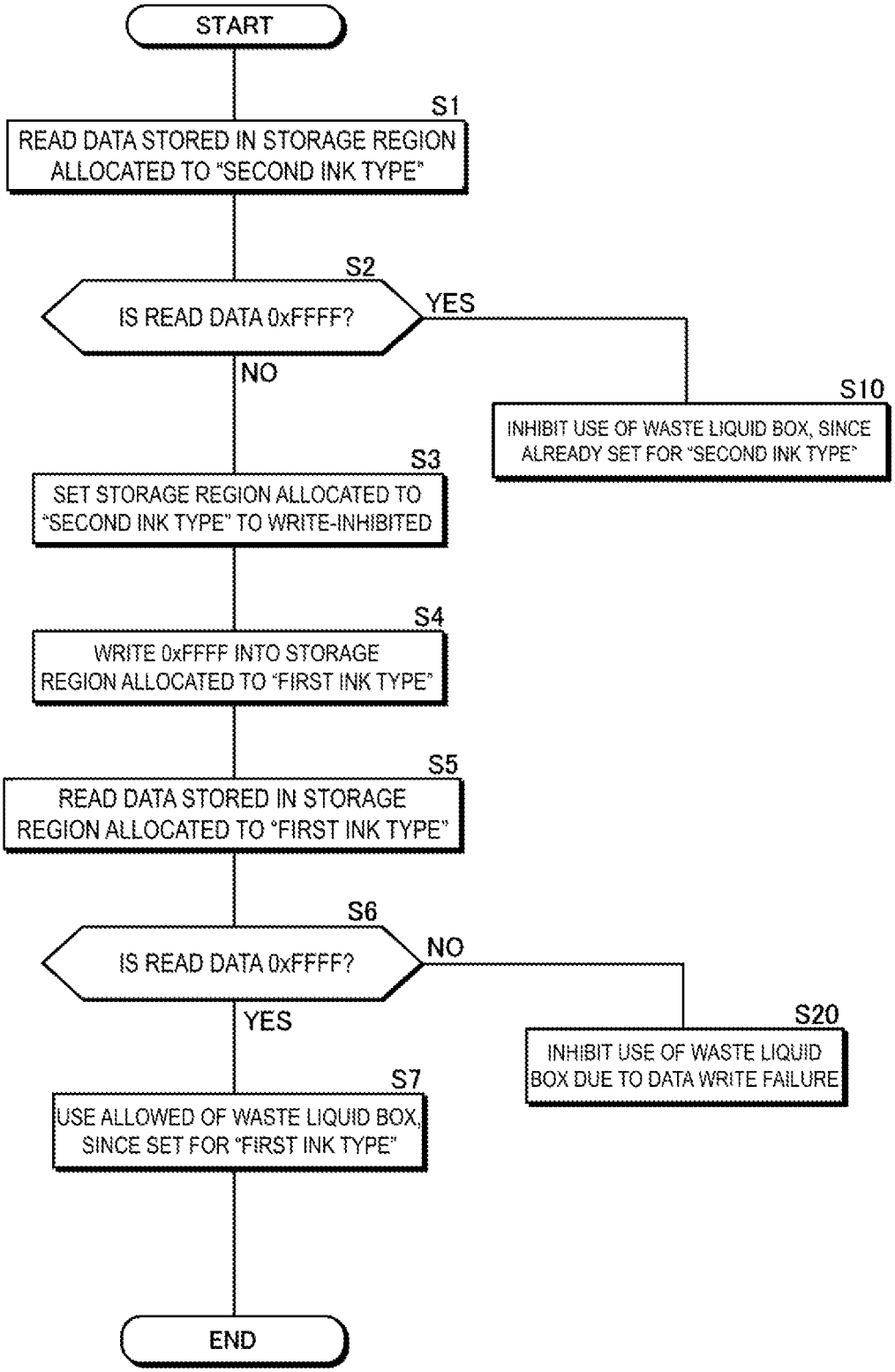
FIG. 4 is a flowchart of processing performed when the waste liquid box is coupled to a printer.

A configuration and management processing for preventing the inks of different ink types from being discharged into the waste liquid box 50 will be described with reference to FIG. 3 and FIG. 4. FIG. 3 is an explanatory diagram of processing to write data into the storage unit provided in the waste liquid box, for setting an ink type to be contained. FIG. 4 is a flowchart of processing performed when the waste liquid box is coupled to the printer.

Referring to FIG. 3, the storage unit 56 of the IC chip 55 provided in the waste liquid box 50 has ten storage regions having addresses 00 to 09 individually allocated to ten types of the ink types. In the present embodiment, the storage region of the address 03 is allocated to the first ink type, and the storage region of the address 07 is allocated to the second ink type. In FIG. 3, an initial state of the waste liquid box 50 at a time of shipment is indicated by A, a state in which writing of data into the storage region of the address 07 is inhibited is indicated by B, and a state in which type specification data "0×FFFF" specifying the ink type is written into the storage region of the address 03 is indicated by C.

In the state indicated by C in FIG. 3, the storage region of the address 03 corresponds to a selected storage region, and the storage region of the address 07 other than the selected storage region is write-inhibited in a state in which data "0×0000" other than the type specification data "0×FFFF" is stored therein. Therefore, writing and rewriting of data into the storage region of the address 07 is disabled.

Hereinafter, in accordance with the flowchart illustrated in FIG. 4, processing will be described for a case in which the waste liquid box 50 is coupled to the first printer 1*a*. When the waste liquid box management unit 23 of the first control unit 10*a* recognizes that the coupling terminal 57 of the IC chip 55 is coupled to the first control unit 10*a*, the waste liquid box management unit 23 performs the processing according to the flowchart illustrated in FIG. 4.

The waste liquid box management unit 23 reads the data stored in the storage region of the address 07 allocated to the "second ink type" at step S1 in FIG. 4. At a subsequent step S2, the waste liquid box management unit 23 determines whether the read data is 0×FFFF. 0×FFFF is the type specification data indicating that the ink type is specified.

When the read data is 0×FFFF, the waste liquid box management unit 23 advances the processing to step S10. In this case, the waste liquid box 50 is already set for the second ink type, and the ink of the first ink type cannot be discharged. Therefore, the waste liquid box management unit 23 inhibits the use of the waste liquid box 50 for the first printer 1*a* that uses the first ink type, and notifies the user, by display on a display unit (not illustrated) or the like, that the waste liquid box 50 cannot be used. Then, the waste liquid box management unit 23 inhibits the use of the waste liquid box 50 for the first printer 1*a*.

On the other hand, when the read data is not 0×FFFF, the waste liquid box management unit 23 advances the processing to step S3. At step S3, the waste liquid box management unit 23 sets the storage region of the address 07 allocated to the "second ink type" to be write-inhibited, and causes it to be in the state indicated by B in FIG. 3. At a subsequent step S4, the waste liquid box management unit 23 writes 0×FFFF into the storage region of the address 03 allocated to the "first ink type". The first ink type corresponds to a predetermined ink type.

At a subsequent step S5, the waste liquid box management unit 23 reads the data stored in the storage region of the address 03. At a subsequent step S6, the waste liquid box management unit 23 determines whether the read data is 0×FFFF. Then, when the read data is 0×FFFF, the waste liquid box management unit 23 advances the processing to step S7. In this case, as illustrated by C in FIG. 3, a state is obtained in which 0×FFFF is correctly written into the storage region of the address 03, and the ink type to be contained in the waste liquid box 50 is set to the first ink type. Therefore, the waste liquid box management unit 23 allows the use of the waste liquid box 50 for the first printer 1*a*.

On the other hand, at step S6, when the read data is not 0×FFFF, the waste liquid box management unit 23 advances the processing to step S20. In this case, since there is a failure in the writing of the data, the waste liquid box management unit 23 notifies the user, by display to the display unit (not illustrated), that the waste liquid box 50 cannot be used. Then, the waste liquid box management unit 23 inhibits the use of the waste liquid box 50 for the first printer 1*a*.

In the second printer 1*b* also, the waste liquid box 50 is mounted on a second mounting portion 15*b*, and when the coupling terminal 57 of the IC chip 55 is coupled to the second control unit 10*b*, similar processing to that of the flowchart illustrated in FIG. 4 is performed. Then, when the waste liquid box 50 is set to be used for the first type of ink, the second control unit 10*b* inhibits the use of the waste liquid box 50 for the second printer 1*b*.

The first printer 1*a*, the waste liquid box 50, the waste liquid box management method performed by the first printer 1*a*, and the waste liquid box management system provided with the first printer 1*a*, the second printer 1*b*, and the waste liquid box 50 according to the present embodiment are configured as described above. According to this configuration, a waste liquid box having a common specification can be used between a plurality of printers using inks of different ink types, while preventing the inks of the different types being mixed and discharged into the waste liquid box. As a result, the inventory management load for the waste liquid boxes can be reduced.

3. Other Exemplary Embodiments

In the embodiment described above, the first printer 1*a* using the ink of the first ink type and the second printer 1*b* using the ink of the second ink type, and the waste liquid box 50 couplable to the first printer 1*a* and the second printer 1*b* are illustrated. As another configuration, the present disclosure can also be applied to a case in which a waste liquid box having a common specification is used in three or more printers using inks of different ink types. In this case, as illustrated in FIG. 3, the storage region corresponding to the ink type to be used may be selected from among the storage regions individually allocated to the plurality of ink types, and the type specification data may be written in.

In the embodiment described above, as illustrated in FIG. 3, ink type identification data is configured by the type specification data written into any one of the storage regions, and by the data other than the type identification data stored in another of the storage regions. Ink types that are allowed to be discharged to the waste liquid box 50 may be set by storing the ink type identification data according to another configuration in the storage unit 56.

At least some of the functional blocks illustrated in FIG. 1 may be achieved in the form of hardware or may be achieved by a cooperation of hardware and software, and the present disclosure is not limited to a configuration in which independent hardware resources are arranged as illustrated in the drawings. The program executed by the CPU 20 is not limited to being storage in the memory 30, and may be stored in a storage device configured separately from the first printer 1*a*. Also, a configuration may be adopted in which the CPU 20 acquires and executes a program stored in an external device.

In addition, a specific detailed configuration of other components of devices configuring the first printer 1*a* may also be modified as desired insofar as it does not depart from the gist and spirit of the present disclosure.

What is claimed is:

1. A waste liquid box management method for setting a type of ink to be contained in a container within a waste liquid box that includes a coupling portion coupled to a printer, the container containing ink discharged from the printer via the coupling portion, and the waste liquid box containing a storage unit, the waste liquid box management method comprising:

individually allocating storage regions in the storage unit to each of a plurality of ink types;

writing predetermined type specification data into a selected storage region of the allocated storage regions, that is the storage region allocated to an ink type to be contained in the container, and inhibiting writing to any storage region of the allocated storage regions other than the selected storage region in a state in which data other than the type specification data is stored therein.

2. The waste liquid box management method according to claim 1, wherein an ink type is associated with the selected storage region in which the type specification data is written, wherein when the type specification data is written into the selection storage region, ink of the ink type associated with the selected storage region is allowed to be discharged into the container, and ink of any ink type that is not associated with the selected storage region is inhibited from being discharged into the container.

3. A waste liquid box comprising:

a coupling portion coupled to a printer;

a container configured to contain ink discharged from the printer via the coupling portion; and a storage unit that stores ink type identification data identifying one of a plurality of ink types, wherein the ink type identification data includes predetermined type specification data written into any one of storage regions of the storage unit, and data, other than the type specification data, stored in a non-rewritable manner in a storage region of the storage unit other than any storage region into which the type specification data is written.

4. A printer using an ink of a predetermined ink type, the printer comprising:

a waste liquid box management unit, wherein, when the printer is coupled by a coupling portion to the waste liquid box, which includes the coupling portion coupled to the printer, a container configured to contain ink discharged from the printer via the coupling portion, and a storage unit storing ink type identification data identifying one of a plurality of ink types, a waste liquid management unit is configured to determine whether the ink type identified by the ink type identification data stored in the storage unit is the predetermined ink type, and, when the ink type is not the predetermined ink type, the waste liquid management unit is configured to perform notification that the waste liquid box is not usable or processing of inhibiting discharge of ink of the predetermined ink type into the waste liquid box.

5. The printer according to claim 4, wherein the storage unit includes different storage regions individually allocated to the plurality of ink types, the ink type identification data includes predetermined type specification data written into any one of the storage regions, and the data other than the type specification data stored in a non-rewritable manner in the storage region other than the storage region into which the type specification data is written, and when an ink type allocated with the storage region in which the type specification data is written is different from the predetermined ink type, the waste liquid box management unit determines that the ink type identified by the ink type identification data is not the predetermined ink type.

6. A waste liquid box management system comprising:

a first printer configured to use ink of a first ink type;

a second printer configured to use ink of a second ink type different from the first ink type; and a waste liquid box including a coupling portion configured to be couplable to any of the first printer and the second printer, a container containing the ink of the first ink type discharged from the first printer or the ink of the second ink type discharged from the second printer, and a storage unit in which storage regions are individually allocated to the first ink type and the second ink type, wherein when the first printer is coupled to the waste liquid box via the coupling portion, the first printer writes predetermined type specification data into the storage region, in the storage unit, allocated to the first ink type, and inhibits writing to the storage region allocated to the second ink type in a state in which data other than the type specification data is stored therein.

7. The waste liquid box management system according to claim 6, wherein in a case where the type specification data is stored in the storage region allocated to the second ink type when the first printer is coupled to the waste liquid box via the coupling portion, the first printer performs notification that the waste liquid box is not usable or processing of inhibiting discharge of the ink of the first ink type into the waste liquid box.

* * * * *